US010174974B2

(12) United States Patent
Nakashima

(10) Patent No.: US 10,174,974 B2
(45) Date of Patent: Jan. 8, 2019

(54) CRYOGENIC REFRIGERATOR AND METHOD OF CONTROLLING CRYOGENIC REFRIGERATOR

(71) Applicant: Sumitomo Heavy Industries, Ltd., Tokyo (JP)

(72) Inventor: Nishiki Nakashima, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 209 days.

(21) Appl. No.: 14/660,391

(22) Filed: Mar. 17, 2015

(65) Prior Publication Data

US 2015/0267942 A1 Sep. 24, 2015

(30) Foreign Application Priority Data

Mar. 18, 2014 (JP) ..... 2014-055331

(51) Int. Cl.
*F25B 9/10* (2006.01)
*F25B 9/14* (2006.01)

(52) U.S. Cl.
CPC ..... *F25B 9/14* (2013.01); *F25B 9/10* (2013.01); *F25B 2309/1428* (2013.01); *F25B 2600/027* (2013.01); *F25B 2600/0271* (2013.01); *F25B 2600/0272* (2013.01); *F25B 2700/171* (2013.01); *F25B 2700/193* (2013.01); *F25B 2700/1931* (2013.01); *F25B 2700/1932* (2013.01)

(58) Field of Classification Search
CPC ..... F25B 9/14; F25B 2700/171; F25B 2700/193; F25B 2700/1931; F25B 2700/1932; F25B 9/10; F25B 2600/027; F25B 2600/0271; F25B 2600/0272
See application file for complete search history.

(56) References Cited

U.S. PATENT DOCUMENTS 5,291,941 A * 3/1994 Enomoto ..... B60H 1/00007 165/43
2010/0186427 A1* 7/2010 Okada ..... F04B 37/08 62/55.5
2010/0313583 A1* 12/2010 Dresens ..... B01D 8/00 62/117

(Continued)

FOREIGN PATENT DOCUMENTS

JP S60-171359 A 9/1985
JP H05-280468 A 10/1993
JP H07-324832 A 12/1995

*Primary Examiner* — Frantz Jules
*Assistant Examiner* — Erik Mendoza-Wilkenfe
(74) *Attorney, Agent, or Firm* — Michael Best & Friedrich LLP

(57) ABSTRACT

An expander generates cold by expanding a refrigerant gas in a cryogenic refrigerator. A compressor compresses the refrigerant gas returning from the expander. Pipes are connected to the expander and the compressor and circulate the refrigerant gas between the expander and the compressor. A determiner determines whether or not a change cycle of the pressure of the refrigerant gas flowing in the pipes is in a predetermined range. The determiner may determine whether or not the change cycle of the pressure of a low-pressure pipe in which a low-pressure refrigerant gas flows toward the compressor from the expander is in a predetermined range.

8 Claims, 7 Drawing Sheets

(56) References Cited

U.S. PATENT DOCUMENTS

| | | | | |
|---|---|---|---|---|
| 2011/0138826 | A1* | 6/2011 | Lifson | F25B 49/025 62/115 |
| 2011/0162959 | A1* | 7/2011 | Okada | F04B 37/08 204/192.1 |
| 2013/0160468 | A1* | 6/2013 | Kimura | F25B 49/022 62/6 |

* cited by examiner

CRYOGENIC REFRIGERATOR AND METHOD OF CONTROLLING CRYOGENIC REFRIGERATOR

RELATED APPLICATION

Priority is claimed to Japanese Patent Application No. 2014-55331, filed on Mar. 18, 2014, the entire content of which is incorporated herein by reference.

BACKGROUND OF THE INVENTION

1. Field of the Invention

The present invention relates to a cryogenic refrigerator that generates cold by expanding a high-pressure refrigerant gas supplied from a compressor and to a method of controlling the cryogenic refrigerator.

2. Description of the Related Art

A Gifford-McMahon (GM) refrigerator is known as a refrigerator that generates cryogenic temperature. A GM refrigerator changes volume of an expansion space by reciprocating a displacer inside a cylinder. In response to this volume change, the expansion space is selectively connected to a discharge side or an intake side of a compressor, thereby expanding a refrigerant gas in the expansion space.

Such a cryogenic refrigerator includes a compressor for compressing a refrigerant gas and an expander for expanding a refrigerant gas. The refrigerant gas passes through a pipe for circulating a refrigerant gas and circulates between the compressor and the expander. For example, a helium gas is used as the refrigerant gas.

In general, a motor is used as a driving unit of a displacer in an expander of a GM refrigerator. In case of a malfunction of the motor for some reason, a load is applied to components such as the displacer and the like, thereby causing the components to be worn out and replaced earlier. Therefore, early detection of a malfunction of the driving unit is desired.

SUMMARY OF THE INVENTION

A purpose of the present invention is to provide a technology for early detection of a malfunction of a driving unit of an expander in a cryogenic refrigerator.

A cryogenic refrigerator according to one embodiment of the present invention includes: an expander that generates cold by expanding a refrigerant gas; a compressor that compresses the refrigerant gas returning from the expander; pipes that are connected to the expander and the compressor and circulate the refrigerant gas between the expander and the compressor; and a determiner that determines whether or not a change cycle of the pressure of the refrigerant gas flowing in the pipes is in a predetermined range.

Another embodiment of the present invention relates to a method of controlling a cryogenic refrigerator including: an expander that generates cold by expanding a refrigerant gas; a compressor that compresses the refrigerant gas returning from the expander; and pipes that circulate the refrigerant gas between the expander and the compressor. The method includes: acquiring a pressure of the refrigerant gas flowing in the pipes; acquiring a change cycle of the acquired pressure; determining whether or not the acquired change cycle is in a predetermined threshold range; and stopping the compressor if the acquired cycle is outside the predetermined threshold range.

BRIEF DESCRIPTION OF THE DRAWINGS

Embodiments will now be described, by way of example only, with reference to the accompanying drawings that are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

An embodiment according to the present invention will be described with reference to the drawings.

Figure 1:
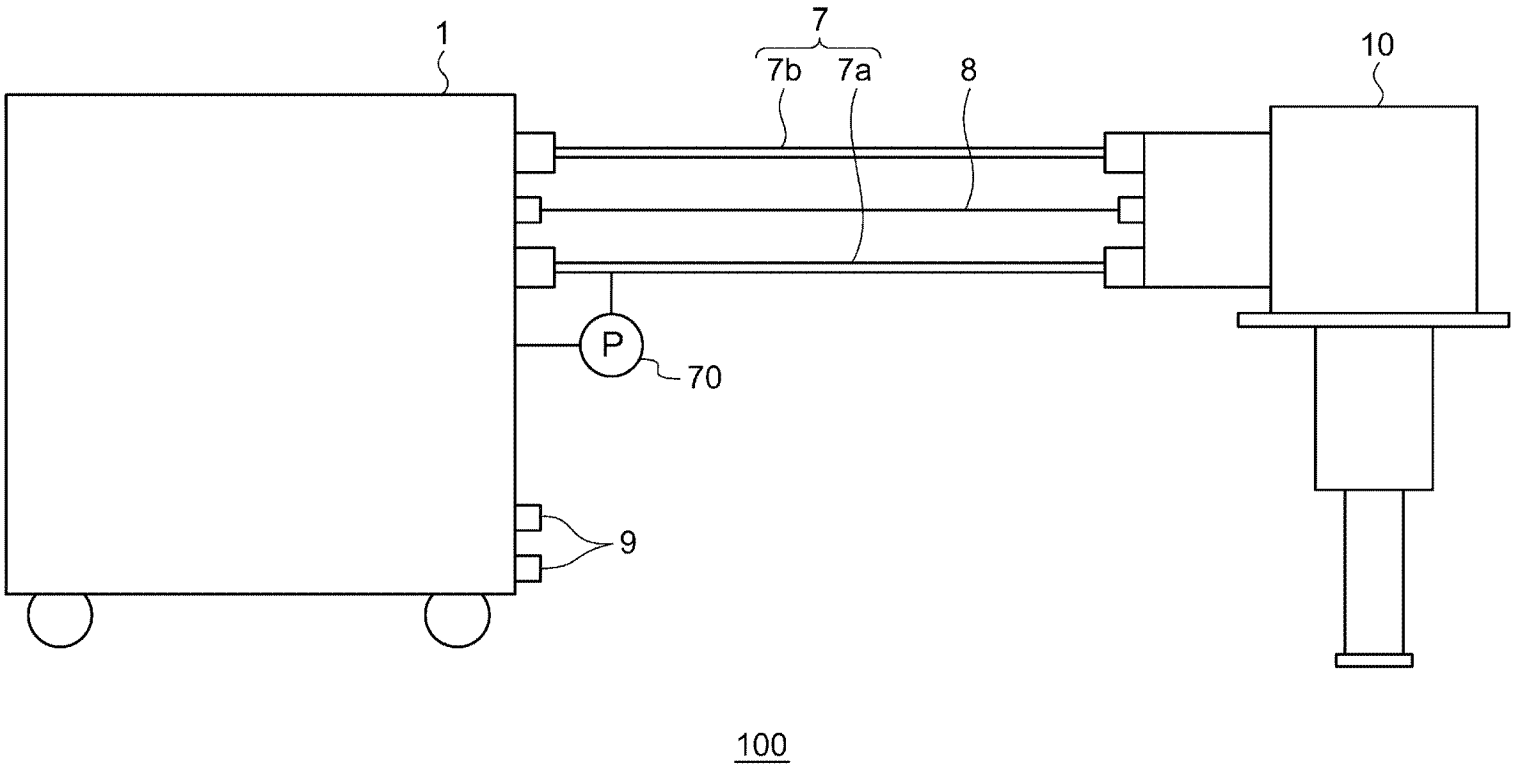
FIG. 1 is a diagram schematically illustrating the configuration of a cryogenic refrigerator according to an embodiment.

First, an entire configuration of a cryogenic refrigerator according to the embodiment will be described. FIG. 1 is a diagram schematically illustrating the configuration of a cryogenic refrigerator 100 according to the embodiment. As shown in FIG. 1, the cryogenic refrigerator 100 includes a compressor 1, an expander 10, one or more pipes 7, a power cable 8, a cooling water pipe connection 9, and a pressure sensor 70.

The compressor 1 compresses a low-pressure refrigerant gas that returns from the expander 10 and supplies a compressed high-pressure refrigerant gas to the expander 10. The expander 10 generates cold by expanding the high-pressure refrigerant gas supplied from the compressor 1. The details of the expander 10 will be described later.

The pipes 7 are connected to the expander 10 and the compressor 1 and circulate a refrigerant gas between the expander 10 and the compressor 1. The pipes 7 include a low-pressure pipe 7*a* and a high-pressure pipe 7*b*. A low-pressure refrigerant gas flowing from the expander 10 to the compressor 1 flows in the low-pressure pipe 7*a*. On the other hand, a high-pressure refrigerant gas flowing from the compressor 1 to the expander 10 flows in the high-pressure pipe 7*b*. The pressure sensor 70 measures the pressure of a refrigerant gas flowing in the pipes 7.

The power cable 8 is connected to the compressor 1 and the expander 10. The power cable 8 is used to supply, from the compressor 1, electrical power that serves as power for the expander 10. The cooling water pipe connection 9 connects a pipe (not shown) in which cooling water flows. The cooling water is used to cool the heat of compression generated by the compression of the refrigerant gas performed by the compressor 1 and to exhaust heat to the outside of the compressor 1.

Figure 2:
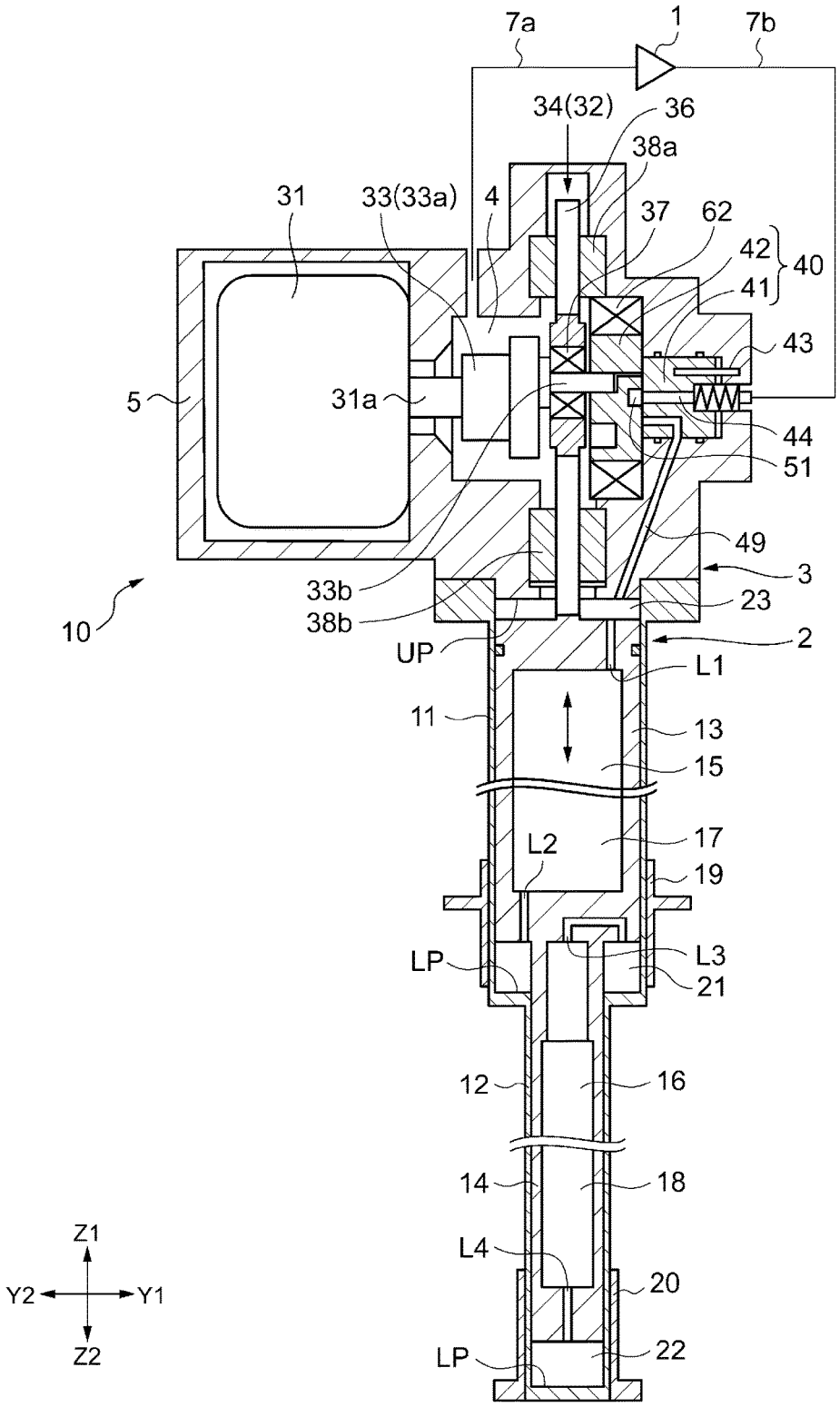
FIG. 2 is a diagram for explaining an expander according to the embodiment.
Figure 3:
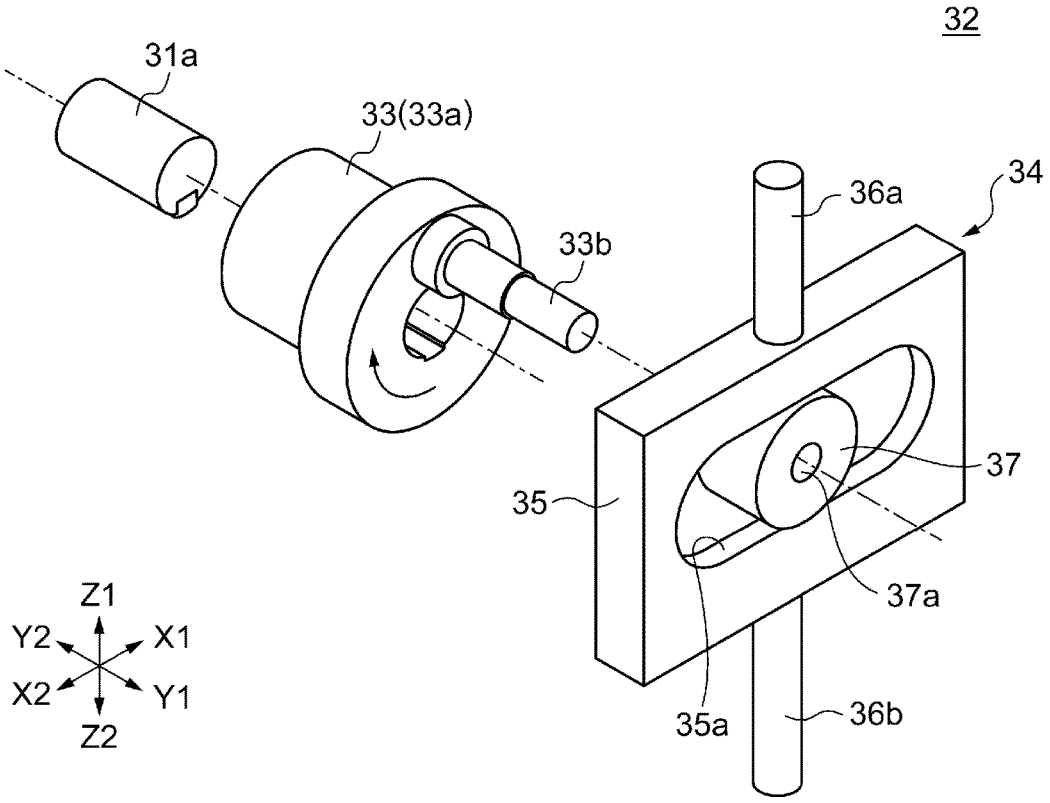
FIG. 3 is an enlarged exploded perspective view illustrating a scotch yoke mechanism.
Figure 4:
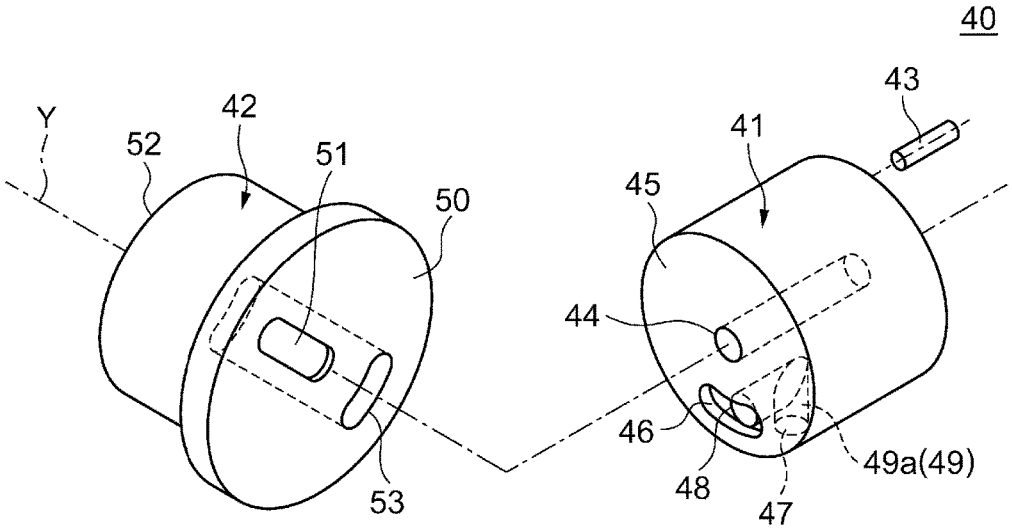
FIG. 4 is an enlarged exploded perspective view illustrating a rotary valve.

FIGS. 2, 3, and 4 are diagrams for explaining an expander 10 according to an embodiment of the present invention. In the embodiment, a Gifford-McMahon refrigerator is used as an example of a cryogenic refrigerator 100, and an expander 10 thereof is explained. The expander 10 according to the embodiment has a cylinder 2, a housing 3, a motor housing unit 5, etc.

In the embodiment, an explanation will be given while using a two-stage expander 10 as an example. In the two-stage expander 10, a cylinder 2 has two sub-cylinders: a first-stage cylinder 11; and a second-stage cylinder 12. A first-stage displacer 13 is inserted inside the first-stage cylinder 11. A second-stage displacer 14 is inserted inside the second-stage cylinder 12.

The first-stage displacer 13 and the second-stage displacer 14 are connected to each other. The first-stage displacer 13 and the second-stage displacer 14 are configured to be able to reciprocate in the cylinder axial direction inside the first-stage cylinder 11 and the second-stage cylinder 12, respectively. A first internal space 15 and a second internal space 16 are formed inside the first-stage displacer 13 and the second-stage displacer 14, respectively. The first internal space 15 and the second internal space 16 are filled with a regenerator material and function as a first regenerator 17 and a second regenerator 18, respectively.

The first-stage displacer 13 located at the upper part is connected to a drive shaft 36 extending upward (in a Z1 direction in the figure). This drive shaft 36 forms a part of a scotch yoke mechanism 32 described later.

A gas flow passage L1 is formed on a high-temperature end side (at an end portion on the side of the Z1 direction) of the first-stage displacer 13. Further, a gas flow passage L2 that allows the first internal space 15 to communicate with a first-stage expansion space 21 is formed on a low-temperature end side (at an end portion on the side of a Z2 direction) of the first-stage displacer 13.

The first-stage expansion space 21 is formed at an end portion on the low-temperature side of the first-stage cylinder 11 (end portion on the side of the direction indicated by an arrow Z2 in FIG. 2). Further, an upper chamber 23 is formed at an end portion on the high-temperature side of the first-stage cylinder 11 (end portion on the side of the direction indicated by an arrow Z1 in FIG. 2).

Further, a second-stage expansion space 22 is formed at an end portion on the low-temperature side inside the second-stage cylinder 12 (end portion on the side of the direction indicated by the arrow Z2 in FIG. 2).

The second-stage displacer 14 is attached to a lower portion of the first-stage displacer 13 by a joint mechanism that is not illustrated. A gas flow passage L3 that allows the first-stage expansion space 21 to communicate with the second internal space 16 is formed at an end portion on the high-temperature side (end portion on the side of the direction indicated by the arrow Z1 in FIG. 2) of this second-stage displacer 14. Further, a gas flow passage L4 that allows the second internal space 16 to communicate with the second-stage expansion space 22 is formed at an end portion on the low-temperature side (end portion on the side of the direction indicated by the arrow Z2 in FIG. 2) of the second-stage displacer 14.

A first-stage cooling stage 19 is disposed at a position facing the first-stage expansion space 21 on an outer peripheral surface of the first-stage cylinder 11. A second-stage cooling stage 20 is disposed at a position facing the second-stage expansion space 22 on an outer peripheral surface of the second-stage cylinder 12.

The above-mentioned first-stage displacer 13 and second-stage displacer 14 move in a vertical direction in the figure (in the directions of the arrows Z1 and Z2) inside the first-stage cylinder 11 and the second-stage cylinder 12, respectively, by means of the scotch yoke mechanism 32.

As shown in FIG. 2, a housing 3 has a rotary valve 40, etc., and a motor housing unit 5 houses a motor 31.

The motor 31, a driving rotary shaft 31*a*, and the scotch yoke mechanism 32 form a drive unit 30. The motor 31 generates rotational driving force, and a rotary shaft (hereafter referred to as "driving rotary shaft 31*a*") that is connected to the motor 31 transmits the rotary motion of the motor 31 to the scotch yoke mechanism 32.

FIG. 3 illustrates a scotch yoke mechanism 32 that is enlarged. The scotch yoke mechanism 32 has a crank 33, a scotch yoke 34, etc. This scotch yoke mechanism 32 can be driven by a driving means, for example, a motor 31 or the like.

The crank 33 is fixed to the driving rotary shaft 31*a*. The crank 33 is configured such that a crank pin 33*b* is provided at a position eccentric from a position where the driving rotary shaft 31*a* is attached. Therefore, when the crank 33 is attached to the driving rotary shaft 31*a*, the crank pin 33*b* becomes eccentric with respect to the driving rotary shaft 31*a*. In this sense, the crank pin 33*b* functions as an eccentric rotating body. The driving rotary shaft 31*a* is rotatably supported at a plurality of sites in a longitudinal direction thereof. More specifically, the driving rotary shaft 31*a* is supported by a first driving rotary bearing, a second driving rotary bearing, and a third driving rotary bearing. The first driving rotary bearing is provided at an end portion of the motor 31 on the side opposite to the scotch yoke mechanism 32. The second driving rotary bearing supports the driving rotary shaft 31*a* at an end portion on the output side of the motor. The third driving rotary bearing supports the driving rotary shaft 31*a* at an end portion on the side connected to the scotch yoke mechanism.

The scotch yoke 34 has a drive shaft 36*a*, a drive shaft 36*b*, a yoke plate 35, a roller bearing 37, etc. A housing space is formed inside the housing 3. This housing space is formed as an airtight container that houses the scotch yoke 34, a rotor valve 42 of the rotary valve 40 described below, and so on and has airtightness. The housing space inside the housing 3 is hereinafter referred to as "airtight container 4" in the present specification. The airtight container 4 communicates with an intake port of the compressor 1 via the low-pressure pipe 7*a*. Therefore, pressure inside the airtight container 4 is maintained to be low.

The drive shaft 36*a* extends upward (in the Z1 direction) from the yoke plate 35. This drive shaft 36*a* is supported by a sliding bearing 38*a* provided inside the housing 3. Therefore, the drive shaft 36*a* is configured to be movable in the vertical direction in the figure (in the directions of the arrows Z1 and Z2 in the figure).

The drive shaft 36*b* extends downward (in the Z2 direction) from the yoke plate 35. This drive shaft 36*b* is supported by a sliding bearing 38*b* provided inside the housing 3. Therefore, the drive shaft 36 is also configured to be movable in the vertical direction in the figure (in the directions of the arrows Z1 and Z2 in the figure).

Since the drive shaft 36*a* and the drive shaft 36*b* are supported by the sliding bearing 38*a* and the sliding bearing 38*b*, the scotch yoke 34 is configured to be movable in the vertical direction (in the directions of the arrows Z1 and Z2 in the figure) inside the housing 3.

It should be noted that a term "shaft direction" or "axial direction" may be used to clearly express a positional relationship of the components of the expander 10 in the present embodiment. The shaft direction is a direction in which the drive shaft 36*a* and the drive shaft 36*b* extend and conforms to the direction in which the first-stage displacer 13 and the second-stage displacer 14 move. For the sake of convenience, relative closeness to the expansion space or the cooling stage may be referred to as "lower" or "downward" and relative remoteness therefrom may be referred to as "upper" or "upward" in relation to the shaft direction. In other words, relative remoteness from the end portion of the low-temperature side may be referred to as "upper" or "upward," and relative closeness thereto may be referred to as "lower" or "downward." It should be noted that these expressions are irrespective of arrangement occurring when the expander 10 is mounted. For example, the expander 10 may be mounted while having the expansion space facing upward in the vertical direction.

A horizontally long window 35*a* is formed on the yoke plate 35. This horizontally long window 35*a* extends in a direction that intersects with the direction in which the drive shaft 36*a* and the drive shaft 36*b* extend, for example, in an orthogonal direction (directions of arrows X1 and X2 in FIG. 3).

The roller bearing 37 is disposed inside this horizontally long window 35*a*. The roller bearing 37 is configured to be rollable inside the horizontally long window 35*a*. Further, a hole 37*a* to be engaged with the crank pin 33*b* is formed at a center position of the roller bearing 37. The horizontally long window 35*a* permits lateral movement of the crank pin 33*b* and the roller bearing 37. The horizontally long window 35*a* includes an upper frame portion and a lower frame portion that extend in the lateral direction, and further includes a first side frame portion and a second side frame portion that extend in the shaft direction or the longitudinal direction at respective lateral end portions of the upper frame portion and the lower frame portion and that connect the upper frame portion with the lower frame portion.

When the motor 31 is driven such that the driving rotary shaft 31*a* rotates, the crank pin 33*b* rotates to draw a circle. With this movement, the scotch yoke 34 reciprocates in the directions of the arrows Z1 and Z2 in the figure. Concurrently, the roller bearing 37 reciprocates in the direction of the arrows X1 and X2 in the figure inside the horizontally long window 35*a*.

The first-stage displacer 13 is connected to the drive shaft 36*b* disposed at a lower portion of the scotch yoke 34. Therefore, when the scotch yoke 34 reciprocates in the directions of the arrows Z1 and Z2 in the figure, the first-stage displacer 13 and the second-stage displacer 14 connected thereto also reciprocate in the directions of the arrows Z1 and Z2 inside the first-stage cylinder 11 and the second-stage cylinder 12, respectively.

A valve mechanism will be described now. In the present embodiment, the rotary valve 40 is used as the valve mechanism.

The rotary valve 40 switches the flow passage of the refrigerant gas. The rotary valve 40 functions as a supply valve that guides a high-pressure refrigerant gas discharged from the discharge side of the compressor 1 to the upper chamber 23 of the first-stage displacer 13 and also functions as an exhaust valve that guides the refrigerant gas from the upper chamber 23 to the intake side of the compressor 1.

This rotary valve 40 has a stator valve 41 and a rotor valve 42 as shown in FIG. 4 as well as in FIG. 2. The stator valve 41 has a flat stator-side sliding surface 45, and the rotor valve 42 also has a flat rotor-side sliding surface 50 in the same way. When this stator-side sliding surface 45 and the rotor-side sliding surface 50 are brought into surface contact with each other, the refrigerant gas is prevented from leaking.

The stator valve 41 is fixed inside the housing 3 by a fixing pin 43. When the stator valve 41 is fixed using this fixing pin 43, the rotation of the stator valve 41 is restricted.

The rotor valve 42 is rotatably supported by a rotor valve bearing 62. An engaging hole (not illustrated) to be engaged with the crank pin 33*b* is formed on an opposite-side end surface 52 located on the side of the rotor valve 42 opposite to the rotor-side sliding surface 50. A tip portion of the crank pin 33*b* projects from the roller bearing 37 in a direction of an arrow Y1 when the crank pin 33*b* is inserted into the roller bearing 37 (see FIG. 2).

The tip portion of the crank pin 33*b* projecting from the roller bearing 37 is engaged with the engaging hole formed on the rotor valve 42. Therefore, the rotor valve 42 rotates in synchronization with the scotch yoke mechanism 32 when the crank pin 33*b* rotates (eccentrically rotates).

The stator valve 41 has a refrigerant gas supply hole 44, an arc-shaped groove 46, and a gas flow passage 49. The refrigerant gas supply hole 44 is connected to the high-pressure pipe 7*b* of the compressor 1 and is formed such that the refrigerant gas supply hole 44 penetrates a center portion of the stator valve 41.

The arc-shaped groove 46 is formed on the stator-side sliding surface 45. The arc-shaped groove 46 has an arc shape that centers the refrigerant gas supply hole 44.

The gas flow passage 49 is formed through both the stator valve 41 and the housing 3. One end portion of the gas flow passage 49 on the side of the valve is open inside the arc-shaped groove 46 and forms an opening 48. A discharge port 47 is open on the side surface of the stator valve 41 in the gas flow passage 49. The discharge port 47 communicates with the part of the gas flow passage 49 inside the housing. Further, the other end portion of the gas flow passage 49 inside the housing is connected to the first-stage expansion space 21 via the upper chamber 23, the gas flow passage L1, the first regenerator 17, and so on.

On the other hand, the rotor valve 42 has an oval-shaped or elongate groove 51 and an arc-shaped hole 53.

The oval-shaped groove 51 is formed on the rotor-side sliding surface 50 such that the oval-shaped groove 51 extends in the radial direction from the center thereof. Further, the arc-shaped hole 53 penetrates the rotor valve 42 from the rotor-side sliding surface 50 to the opposite-side end surface 52 and is connected to the airtight container 4. The arc-shaped hole 53 is formed such that the arc-shaped hole 53 is positioned at the same circumference as the arc-shaped groove 46 of the stator valve 41.

A supply valve is formed of the refrigerant gas supply hole 44, the oval-shaped groove 51, the arc-shaped groove 46, and the opening 48. Further, an exhaust valve is formed of the opening 48, the arc-shaped groove 46, and the arc-shaped hole 53. In the present embodiment, spaces that exist inside valves such as the oval-shaped groove 51 and the arc-shaped groove 46 may be collectively referred to as a valve internal space.

In the expander 10 thus configured, the scotch yoke 34 reciprocates in the Z1 and Z2 directions when the rotational driving force of the motor 31 is transmitted to the scotch yoke mechanism 32 via the driving rotary shaft 31*a* while causing the scotch yoke mechanism 32 to be driven. Due to this movement of the scotch yoke 34, the first-stage displacer 13 and the second-stage displacer 14 reciprocate between a bottom dead center LP and a top dead center UP inside the first-stage cylinder 11 and the second-stage cylinder 12, respectively.

When the first-stage displacer 13 and the second-stage displacer 14 reach the bottom dead center LP, the exhaust valve closes, and the supply valve opens. In other words, a refrigerant gas flow passage is formed through the refrigerant gas supply hole 44, the oval-shaped groove 51, the arc-shaped groove 46, and the gas flow passage 49.

Therefore, a high-pressure refrigerant gas starts filling the upper chamber 23 from the compressor 1. Subsequently, the first-stage displacer 13 and the second-stage displacer 14 pass the bottom dead center LP and start moving upward, and the refrigerant gas passes the first regenerator 17 and the second regenerator 18 from the upper side to the lower side, filling the first-stage expansion space 21 and the second-stage expansion space 22.

When the first-stage displacer 13 and the second-stage displacer 14 reach the top dead center UP, the supply valve closes, and the exhaust valve opens. In other words, a refrigerant gas flow passage is formed through the gas flow passage 49, the arc-shaped groove 46, and the arc-shaped hole 53.

Due to this, the high-pressure refrigerant gas expands inside the first-stage expansion space 21 and the second-stage expansion space 22, thereby generating cold and cooling the first-stage cooling stage 19 and the second-stage cooling stage 20. Further, a low-temperature refrigerant gas that has generated cold flows from the lower side to the upper side while cooling the regenerator materials inside the first regenerator 17 and the second regenerator 18 and then flows back to the low-pressure pipe 7*a*.

Then, when the first-stage displacer 13 and the second-stage displacer 14 reach the bottom dead center LP, the exhaust valve closes, and the supply valve opens, ending one cycle. By repeating the cycle of compression and expansion of the refrigerant gas in this manner, the first-stage cooling stage 19 and the second-stage cooling stage 20 of the expander 10 are cooled to a cryogenic temperature. The first-stage cooling stage 19 and the second-stage cooling stage 20 of the expander 10 conduct the cold generated by the expansion of the refrigerant gas inside the first-stage expansion space 21 and the second-stage expansion space 22 to the outside of the first-stage cylinder 11 and the second-stage cylinder 12, respectively.

In this manner, cold is generated by converting the driving force of the drive unit such as the motor 31 to reciprocating movement of the first-stage displacer 13 and the second-stage displacer 14 in the expander 10 according to the embodiment. Thereby, the temperature of the second-stage cooling stage 20 becomes a cryogenic temperature of approximately 4K.

The motor 31 is an electrical component. If the torque of the motor 31 is lowered due to, for example, degradation over time or the like, a malfunction such as a loss of synchronism of the motor 31 can occur. Such a malfunction may be detected by, for example, monitoring current that flows through the power cable 8 and detecting overcurrent that flows through the motor 31. However, such an approach may not be useful in detecting a minor malfunction of the motor 31. If the cryogenic refrigerator 100 is operated in a state where there is a minor malfunction in the motor 31, additional loads may be applied to components such as the scotch yoke mechanism 32, the first-stage displacer 13, the second-stage displacer 14, and the like. If such a condition continues, the loads may repeatedly affect on these components, and, in an extreme case, the components may need to be replaced earlier. Also, if a lag in the timing of the pressure change of the expander 10 happens, it may lower the refrigeration capacity.

As described above, the motor 31 also serves as a power source for the rotor valve 42. The rotor valve 42 periodically switches between the supplying of a high-pressure refrigerant gas to the expander 10 from the compressor 1 and the discharging of a low-pressure refrigerant gas to the compressor 1 from the expander 10. The pressure of a refrigerant gas in the expander 10 periodically changes in accordance with this switching. The high-pressure pipe 7*b* communicates with the high-pressure side of the compressor 1 at all times. Therefore, the pressure of a refrigerant gas in the high-pressure pipe 7*b* may be considered to be almost equal to the discharge pressure of the compressor 1. Similarly, since the low-pressure pipe 7*a* communicates with the intake side of the compressor 1 at all times, the pressure of a refrigerant gas in the low-pressure pipe 7*a* may be considered to be almost equal to the intake pressure of the compressor 1.

However, more precisely, when the high-pressure pipe 7*b* communicates with the first-stage expansion space 21 or the second-stage expansion space 22 (hereinafter, these are simply referred to as "expansion spaces") of the expander 10, the pressure of the refrigerant gas in the high-pressure pipe 7*b* is slightly lowered. Then, when the communication of the high-pressure pipe 7*b* with the expansion spaces of the expander 10 is blocked, the pressure of the refrigerant gas in the high-pressure pipe 7*b* returns to the original state. On the other hand, when the low-pressure pipe 7*a* communicates with the expansion spaces of the expander 10, the pressure of the refrigerant gas in the low-pressure pipe 7*a* is slightly raised. Then, when the communication of the low-pressure pipe 7*a* with the expansion spaces is blocked, the pressure inside the low-pressure pipe 7*a* returns to the original state. Accordingly, the pressure of the refrigerant gas inside the low-pressure pipe 7*a* and the pressure of the refrigerant gas inside the high-pressure pipe 7*b* are not constant and change infinitesimally in a cycle that is similar to that of a change in volume of the expansion spaces. Therefore, if a malfunction such as a loss of synchronism or the like occurs in the motor 31, the change cycle of the pressure of the refrigerant gas inside the pipes 7 also changes.

According to the embodiment, the cryogenic refrigerator 100 monitors the change cycle of the pressure of the refrigerant gas flowing in the pipes 7. The cryogenic refrigerator 100 determines whether or not this cycle is in a predetermined range. If the cryogenic refrigerator 100 determines that the cycle is outside the predetermined range, the cryogenic refrigerator 100 notifies the user accordingly. Thereby, a failure of the motor 31 can be detected early. A detailed explanation will be given regarding the monitoring of the pressure of a refrigerant gas in the following.

Figure 5:
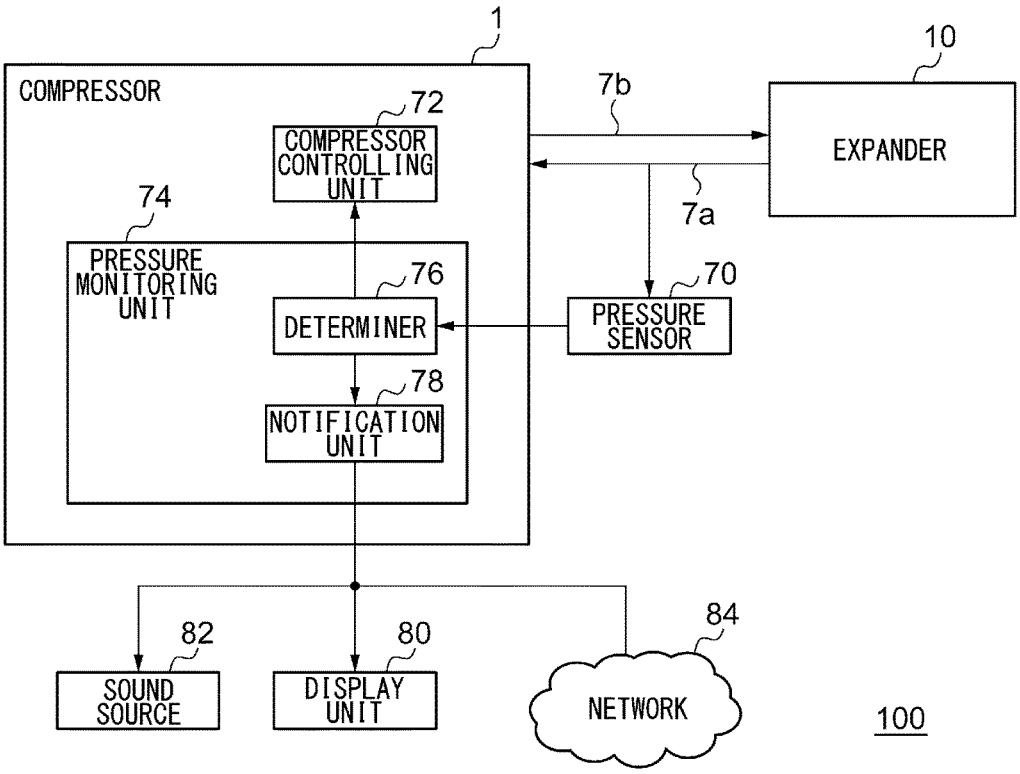
FIG. 5 is a diagram schematically illustrating the functional configuration of the cryogenic refrigerator according to the embodiment.

FIG. 5 is a diagram schematically illustrating the functional configuration of the cryogenic refrigerator 100 according to the embodiment. The cryogenic refrigerator 100 includes a compressor 1, an expander 10, a pressure sensor 70, a display unit 80, and a sound source 82. The cryogenic refrigerator 100 is also connected to a network 84.

The expander 10 generates cold by expanding a high-pressure refrigerant gas supplied from the compressor 1. The pressure sensor 70 measures the pressure of the pipes 7. A pressure change due to the switching between the supplying and discharging of a refrigerant gas described above appears more prominently in the low-pressure pipe 7*a* than the high-pressure pipe 7*b*. This is because, since a refrigerant gas supplied from a pump (not shown) of the compressor 1 flows to the high-pressure pipe 7*b*, the pressure of the refrigerant gas flowing through the high-pressure pipe 7*b* is affected by a pressure change that occurs due to the pump cycle. The pressure sensor 70 preferably measures the pressure of the low-pressure pipe 7*a*.

The compressor 1 includes a compressor controlling unit 72 and a pressure monitoring unit 74. The pressure monitoring unit 74 includes a determiner 76 and a notification unit 78. The compressor controlling unit 72 and the pressure monitoring unit 74 can be implemented in hardware by a processor such as a CPU (Central Processing Unit), a main memory, or other LSI's (Large Scale Integrations). The compressor controlling unit 72 and the pressure monitoring unit 74 are also implemented in software by a program loaded in the memory, etc. Thus, a person skilled in the art should appreciate that there are many ways of accomplishing these functional blocks in various forms in accordance with the components of hardware only, software only, or the combination of both, and the way of accomplishing these functional blocks is not limited to any particular one.

The compressor controlling unit 72 controls the movement of the compressor 1 in an integrated manner. More specifically, the compressor controlling unit 72 performs the activation and stopping of the pump (not shown) and the control on electrical power supply to the expander 10.

Figure 6:
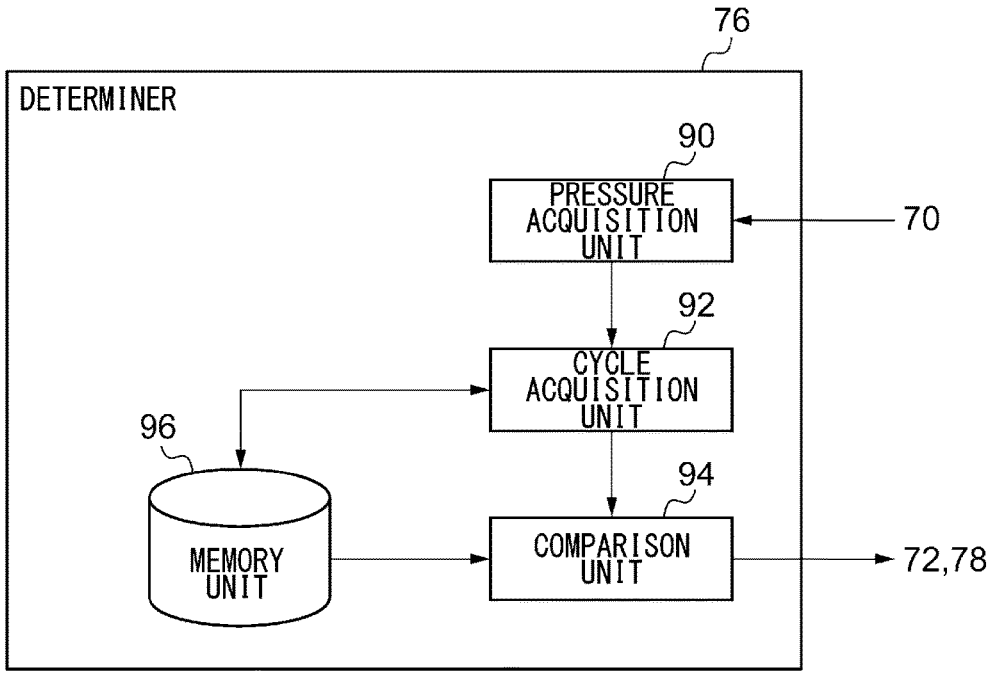
FIG. 6 is a diagram schematically illustrating the functional configuration of a determiner according to the embodiment.

FIG. 6 is a diagram schematically illustrating the functional configuration of the determiner 76 according to the embodiment. The determiner 76 includes a pressure acquisition unit 90, a cycle acquisition unit 92, a comparison unit 94, and a memory unit 96.

The pressure acquisition unit 90 acquires, from the pressure sensor 70, the pressure of a refrigerant gas flowing through the low-pressure pipe 7*a*. The pressure acquisition unit 90 acquires the pressure of the refrigerant gas in a predetermined time interval (for example, every 0.1 second) and accumulates the pressure in the memory unit 96. The cycle acquisition unit 92 analyzes pressure data for the refrigerant gas accumulated in the memory unit 96 and derives a change cycle T of the pressure of the refrigerant gas. In general, when the cryogenic refrigerator 100 is under normal operation, a cycle $T_0$ for switching between the supplying and discharging of a refrigerant gas is constant. This cycle varies depending on the type of the cryogenic refrigerator 100. An example of the cycle is one second. The switching cycle $T_0$ and a range R are stored in advance in a memory unit 77.

The comparison unit 94 reads out the switching cycle $T_0$ from the memory unit 77. The comparison unit 94 compares whether or not the pressure change cycle T of the refrigerant gas derived by the cycle acquisition unit 92 is in a predetermined range R. In this case, the "range R" is a criterion for determining a malfunction that is defined in order for the determiner 76 to determine whether or not a malfunction occurs in the motor 31. The range R may be defined through experiments according to the type of the cryogenic refrigerator 100. For example, the range R is in a range of plus or minus five percent of the cycle $T_0$ for switching. As a specific example, the range R is in a range of 0.95 seconds or more and 1.05 seconds or less if the cycle $T_0$ is one second. Upon determining that the refrigerant gas pressure change cycle T is outside the predetermined range R, the comparison unit 94 reports a signal indicating that the change cycle T is outside the predetermined range R to the compressor controlling unit 72 and the notification unit 78.

FIG. 5 is further explained. Upon receiving the signal indicating that the change cycle of the pressure of the refrigerant gas is outside the predetermined range R from the comparison unit 94 inside the determiner 76, the notification unit 78 notifies the user of the cryogenic refrigerator 100 accordingly. The "user" in this case includes not only those who are using the cryogenic refrigerator 100 but also those who are in charge of the maintenance and inspection of the cryogenic refrigerator 100.

Upon receiving the signal, the notification unit 78 displays that the receipt of the signal on the display unit 80. The display unit 80 is, for example, a light emitting diode (LED) light source, an LED indicator, or a liquid crystal monitor, provided with the compressor 1. Upon receiving the signal from the comparison unit 94, the display unit 80 flashes or displays a message reporting that the motor 31 is malfunctioning.

Upon receiving the signal indicating that the change cycle of the pressure of the refrigerant gas is outside the predetermined range R from the comparison unit 94 inside the determiner 76, the notification unit 78 may generate a sound from the sound source 82. Upon receiving the signal, the notification unit 78 may further transmit an email to the user via the network 84 such as the Internet. These can give the user a warning of a malfunction of the motor 31 at an early stage, and the user is able to take an appropriate measure.

Upon receiving the signal indicating that the change cycle of the pressure of the refrigerant gas is outside the predetermined range R from the comparison unit 94 inside the determiner 76, the compressor controlling unit 72 may stop the operation of the compressor 1. This allows the cryogenic refrigerator 100 to be stopped at a point where the malfunction of the motor 31 is minor. Thus, damage to the components of the cryogenic refrigerator 100 can be stopped at an early point, and damage accumulated in these components can be reduced. Thereby, the number of components that are to be repaired or replaced can be reduced.

Figure 7:
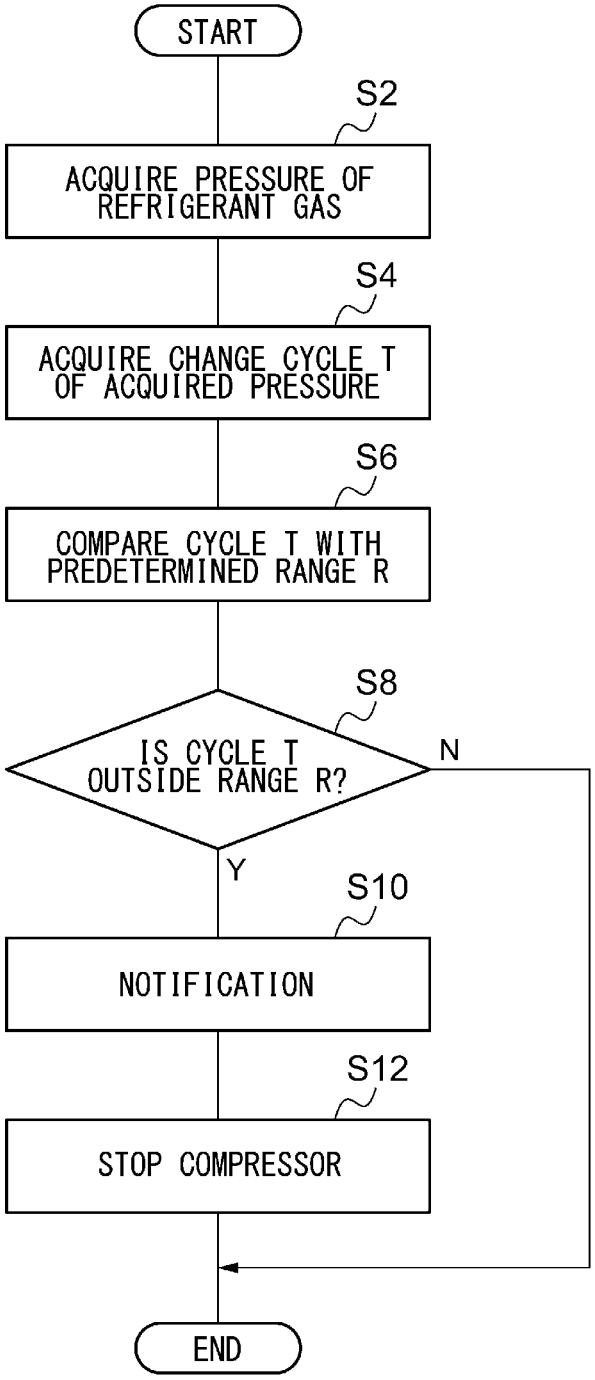
FIG. 7 is a flow chart explaining the flow of a control process performed by the cryogenic refrigerator according to the embodiment.

FIG. 7 is a flow chart explaining the flow of a control process performed by the cryogenic refrigerator 100 according to the embodiment. The process in the flowchart is started, for example, when the compressor 1 is activated.

The pressure acquisition unit 90 acquires, from the pressure sensor 70, the pressure of a refrigerant gas flowing in the low-pressure pipe 7*a* (S2). The cycle acquisition unit 92 analyzes the pressure acquired by the pressure acquisition unit 90 and acquires the pressure change cycle T (S4). The comparison unit 94 compares the cycle T acquired by the cycle acquisition unit 92 with the predetermined range R related to the cycle (S6).

If the cycle T is outside the predetermined range R (Y in S8), the notification unit 78 notifies the user accordingly (S10). The compressor controlling unit 72 stops the operation of the compressor (S12). When the compressor controlling unit 72 stops the operation of the compressor or the cycle T is in the predetermined range R (N in S8), the process in this flowchart is ended.

As described above, the cryogenic refrigerator 100 according to the embodiment allows for early detection of a malfunction of the motor 31, which is a driving unit of the expander 10 of the cryogenic refrigerator.

While the present invention has been described based on the embodiment, the embodiment is merely illustrative of the principles and applications of the present invention. Additionally, many variations and changes in arrangement may be made in the embodiment without departing from the spirit of the present invention as defined by the appended claims.

In the above explanation, it has been explained that the cycle acquisition unit 92 of the determiner 76 acquires the periodic change of the pressure of a refrigerant gas flowing in the pipes 7. The cycle acquisition unit 92 may acquire an average value of a predetermined number of cycles of pressure change of the refrigerant gas. The comparison unit 94 may determine whether or not the average value of the predetermined number (for example, three) of cycles T of pressure change of the refrigerant gas is in the predetermined range R. With this, the average value is very likely to fall in the range R when only one cycle T is accidentally outside the range R. Therefore, stopping of the operation of the cryogenic refrigerator 100 can be prevented when only one cycle T is accidentally outside the range R for some reasons. In other words, the accuracy of detection of a malfunction of the motor 31 can be increased.

In the above explanation, the pressure monitoring unit 74 is assumed to be inside the compressor 1. However, the pressure monitoring unit 74 may be outside the compressor. Similarly, the pressure sensor 70 may be incorporated inside the compressor 1.

In the above explanation, a case has been explained where the cycle acquisition unit 92 derives the periodic change of the pressure of the refrigerant gas flowing in the pipes 7. The "cycle" in this case encompasses the concept of timing broadly. Therefore, a person skilled in the art should appreciate that, for example, the cycle acquisition unit 92 may derive the frequency of pressure change of the refrigerant gas flowing in the pipes 7.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

an expander that generates cold by expanding a refrigerant gas in an expansion space;

a compressor that compresses the refrigerant gas returning from the expansion space of the expander;

pipes that are connected to the expansion space of the expander and the compressor and circulate the refrigerant gas between the expansion space of the expander and the compressor, the pipes including a high-pressure pipe in which a high-pressure refrigerant gas flows toward the expansion space of the expander from the compressor and a low-pressure pipe in which a low-pressure refrigerant gas flows toward the compressor from the expansion space of the expander; and a determiner that determines whether or not a frequency of pressure change of the refrigerant gas flowing in the pipes is in a predetermined range, wherein the determiner comprises:

a memory unit that prestores a switching cycle for switching between supplying and discharging of the refrigerant gas under normal operation of the cryogenic refrigerator, a pressure acquisition unit that acquires pressure data of the refrigerant gas in a predetermined time interval and accumulates the pressure data in the memory unit, a cycle acquisition unit that analyzes the pressure data of the refrigerant gas accumulated in the memory unit and derives the frequency of pressure change, and a comparison unit that reads out the switching cycle from the memory unit and determines whether or not the frequency of pressure change is in the predetermined range.

2. The cryogenic refrigerator according to claim 1, wherein pressure drop of the refrigerant gas flowing in the high-pressure pipe occurs when the high-pressure pipe communicates with the expansion space of the expander, and wherein pressure rise of the refrigerant gas flowing in the low-pressure pipe occurs when the low-pressure pipe communicates with the expansion space of the expander.

3. The cryogenic refrigerator according to claim 1, wherein the determiner is configured to determine whether or not an average value of a predetermined number of the frequency of pressure change is in the predetermined range.

4. The cryogenic refrigerator according to claim 1, wherein the determiner includes a notification unit that, when the determiner determines that the frequency of pressure change is outside the predetermined range, reports that the frequency of the pressure change is outside the predetermined range.

5. A method of controlling a cryogenic refrigerator comprising: an expander that generates cold by expanding a refrigerant gas in an expansion space; a compressor that compresses the refrigerant gas returning from the expansion space of the expander; and pipes that circulate the refrigerant gas between the expansion space of the expander and the compressor, the pipes including a high-pressure pipe in which a high-pressure refrigerant gas flows toward the expansion space of the expander from the compressor and a low-pressure pipe in which a low-pressure refrigerant gas flows toward the compressor from the expansion space of the expander, the method comprising:

analyzing, by the compressor, a pressure of the refrigerant gas flowing in the pipes to acquire a frequency of pressure change of the refrigerant gas flowing in the pipes;

determining, by the compressor, whether or not the frequency of pressure change is in a predetermined threshold range; and stopping the compressor when the frequency of pressure change is outside the predetermined threshold range.

6. The cryogenic refrigerator according to claim 1, wherein the determiner is configured to use, as the frequency of pressure change, a time interval between consecutive pressure changes of the refrigerant gas flowing in the pipes.

7. The cryogenic refrigerator according to claim 1, wherein the cycle acquisition unit is configured to derive a time interval between consecutive pressure changes of the refrigerant gas flowing in the pipes.

8. The cryogenic refrigerator according to claim 7, wherein the comparison unit is configured to determine whether or not the time interval is in the predetermined range.

* * * * *